US009840684B2

(12) United States Patent
Scheibel et al.

(10) Patent No.: US 9,840,684 B2
(45) **Date of Patent: *Dec. 12, 2017**

(54) COMPOSITIONS CONTAINING ALKYL SULFATES AND/OR ALKOXYLATED ALKYL SULFATES AND A SOLVENT COMPRISING A DIOL

(71) Applicant: The Procter & Gamble Company, Cincinnati, OH (US)

(72) Inventors: Jeffrey John Scheibel, Glendale, OH (US); Scott Leroy Cron, Liberty Township, OH (US); Patrick Christopher Stenger, Fairfield, OH (US); Praveen Kumar Depa, Hyde Park, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/058,413

(22) Filed: Mar. 2, 2016

(65) Prior Publication Data

US 2017/0253837 A1 Sep. 7, 2017

(51) Int. Cl.

| | |
|---|---|
| ***C11D 1/12*** | (2006.01) |
| ***C11D 1/29*** | (2006.01) |
| ***C11D 3/386*** | (2006.01) |
| ***C11D 11/00*** | (2006.01) |
| ***C11D 3/43*** | (2006.01) |
| ***C11D 1/22*** | (2006.01) |
| ***C11D 17/00*** | (2006.01) |
| ***C11D 17/04*** | (2006.01) |

(52) U.S. Cl.

CPC ..... *C11D 3/43* (2013.01); *C11D 1/22* (2013.01); *C11D 1/29* (2013.01); *C11D 11/0017* (2013.01); *C11D 17/003* (2013.01); *C11D 17/0008* (2013.01); *C11D 17/042* (2013.01); *C11D 17/045* (2013.01)

(58) Field of Classification Search

CPC ..... C11D 1/12; C11D 1/29; C11D 3/2006; C11D 3/2041; C11D 3/2044; C11D 3/386; C11D 11/00

See application file for complete search history.

(56) References Cited

U.S. PATENT DOCUMENTS

| | | | |
|---|---|---|---|
| 2,343,829 A | 3/1944 | Clayton | |
| 4,889,652 A | 12/1989 | Sullivan et al. | |
| 6,831,048 B2 | 12/2004 | Kezuka et al. | |
| 6,916,781 B2 | 7/2005 | DuVal et al. | |
| 6,989,072 B2 | 1/2006 | Catlin et al. | |
| 8,143,458 B2 | 3/2012 | Kalagias | |
| 8,183,199 B2 | 5/2012 | Fossum et al. | |
| 8,617,417 B2 | 12/2013 | Inaba et al. | |
| 8,835,374 B2 | 9/2014 | Guida et al. | |
| 9,165,760 B2 | 10/2015 | Fu et al. | |
| 9,404,071 B2 | 8/2016 | Labeque et al. | |
| 9,624,457 B2 | 4/2017 | Labeque et al. | |
| 2003/0217764 A1 | 11/2003 | Masuda et al. | |
| 2005/0003977 A1 | 1/2005 | Itano et al. | |
| 2010/0313360 A1 | 12/2010 | Menting et al. | |
| 2011/0230380 A1 | 9/2011 | Holzhauer et al. | |
| 2011/0239377 A1 | 10/2011 | Fossum et al. | |
| 2014/0112964 A1 | 4/2014 | Wu | |
| 2015/0190325 A1 | 7/2015 | Ino | |
| 2015/0329807 A1* | 11/2015 | Naqvi | C11D 3/2041 206/524.7 |
| 2016/0355752 A1 | 12/2016 | Souter et al. | |
| 2016/0355753 A1 | 12/2016 | Gummel et al. | |
| 2016/0355754 A1 | 12/2016 | Somerville-Roberts et al. | |
| 2016/0355755 A1 | 12/2016 | Brooker et al. | |
| 2016/0355762 A1 | 12/2016 | Brooker et al. | |
| 2016/0355763 A1 | 12/2016 | Somerville-Roberts et al. | |
| 2016/0355766 A1 | 12/2016 | Brooker et al. | |
| 2016/0355767 A1 | 12/2016 | Souter et al. | |

FOREIGN PATENT DOCUMENTS

| | | |
|---|---|---|
| EP | 0 344 909 | 6/1989 |
| EP | 2 368 970 | 6/2015 |
| EP | 1 462 514 | 1/2016 |
| FR | 2 187 287 A1 | 1/1974 |
| WO | WO 93/03129 | 2/1993 |
| WO | WO 97/03172 | 1/1997 |

OTHER PUBLICATIONS

U.S. Appl. No. 15/058,403, filed Mar. 2, 2016, Jeffrey John Scheibel, et al.

U.S. Appl. No. 15/058,424, filed Mar. 2, 2016, Jeffrey John Scheibel, et al.

International Search report for application No. PCT/US2017/020320, dated May 24, 2017, 15 pages.

International Search report for application No. PCT/US2017/020321, dated May 30, 2017, 14 pages.

International Search report for application No. PCT/US2017/020322, dated May 30, 2017, 14 pages.

* cited by examiner

*Primary Examiner* — Brian P Mruk

(74) *Attorney, Agent, or Firm* — Gregory S. Darley-Emerson; Leonard W. Lewis; Steven W. Miller

(57) ABSTRACT

The present invention relates generally to compositions containing an anionic surfactant selected from the group consisting of alkyl sulfates, alkoxylated alkyl sulfates, and mixtures thereof, and a solvent, particularly a solvent comprising one or more diols.

14 Claims, No Drawings

COMPOSITIONS CONTAINING ALKYL SULFATES AND/OR ALKOXYLATED ALKYL SULFATES AND A SOLVENT COMPRISING A DIOL

TECHNICAL FIELD

The present invention relates generally to compositions containing an anionic surfactant selected from the group consisting of alkyl sulfates, alkoxylated alkyl sulfates, and mixtures thereof, and a solvent, particularly a solvent comprising one or more diols.

BACKGROUND

Fluid detergent products, such as liquids, gels, pastes and the like, are preferred by many consumers over solid detergents. Fluid detergent products may contain surfactants, e.g., anionic surfactants, and one or more solvents, in addition to water. Solvents may provide a variety of benefits: solvents may allow for the formulation of anionic surfactant-rich surfactant systems, particularly for compacted fluid detergents; solvents may adjust the viscosity of a formulation; solvents may allow for the formulation of an isotropic and physically stable formulation; and solvents may allow for the formulation of enzymes, polymers, bleach, chelants, and other ingredients that improve cleaning. Solvents may also be used to formulate stable, shippable, anionic surfactant concentrates, which may be combined downstream with other detergent ingredients to form a final detergent product. Also, some fluid detergent forms, such as fluid unit dose articles, may contain high levels of anionic surfactant and high levels of solvent, such as 30% or more solvent by weight of the total formulation.

Known solvents for use in fluid detergent formulations include 1,2-propane diol (p-diol), ethanol, diethylene glycol (DEG), 2-methyl-1,3-propanediol (MPD), dipropylene glycol (DPG), oligamines (e.g., diethylenetriamine (DETA), tetraethylenepentamine (TEPA), and glycerine (which may, for example, be used in fluid unit dose articles). However, these known solvents all have significant disadvantages, particularly if used at increased levels, including cost, formulatability, dissolution rate, solubility/stability of film in certain fluid unit dose articles, and potential adverse effects on cleaning and/or whiteness. Thus, there remains an ongoing need to identify new solvents that may allow for the formulation of increased concentrations of anionic surfactants in fluid detergent compositions, particularly compact fluid detergent compositions and concentrated surfactant pastes, and may address one or more of the disadvantages of known solvents discussed above.

A water soluble package formed from a water soluble film containing a substantially non-aqueous liquid composition comprising a surfactant and a primary solvent that is a diol having a Hansen hydrogen-bonding solubility parameter greater than 20, where the hydroxyl groups present in the diol are terminal groups and the distance between these groups is 3 carbon atoms, is known. The liquid composition may also contain a secondary solvent and suitable secondary solvents include glycerine, ethylene glycol, trimethylene glycol, tetramethylene glycol, pentamethylene glycol, propylene glycol, diethylene glycol, 2,3-butanediol, 1,4-butanediol, 1,3-butanediol, and triethanolamine. This known liquid unit dose product addresses the challenge of preserving the physical integrity and stability of the film and the full capsule.

A concentrated light duty liquid detergent comprising 50 to 68% of a mixture of anionic and non-ionic surfactants suspended in 9 to 18% of an organic solvent, in particular an alkane diol having 3 to 6 carbons and no more than 2 hydroxy groups, is also known.

Also known is a non-aqueous liquid fabric treating composition comprising: a continuous, non-aqueous liquid phase comprising a detersively effective amount of at least one nonionic surfactant; a suspended particle phase, suspended in the non-aqueous liquid phase, comprising a detergent building effective amount of at least one particulate detergent builder salt; and a stabilizer in an amount of about 0.05% to about 1.0% by weight of the composition to inhibit phase separation of the composition, the stabilizer comprising a compound having the formula

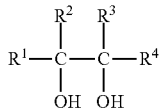

where $R^1$, $R^2$, $R^3$ and $R^4$, independently, represent H, lower alkyl of up to 6 carbon atoms, hydroxy-substituted lower alkyl of up to 6 carbon atoms, or aryl, and $R^1$ and $R^4$, together with the carbon atoms to which they are attached, may form a 5- or 6-membered carbocyclic ring, with the proviso that no more than two of $R^1$, $R^2$, $R^3$ and $R^4$ may be aryl.

A solvent-welding process for water-soluble films, characterized in that the solvent comprises a glycol which is a member selected from the group consisting of ethylene glycol; 2,2-propanediol; 1,2-propanediol; 1,3-propanediol; tetramethylene glycol; pentamethylene glycol; hexamethyene glycol, glycerol; 2,3-butane diol; diethylene glycol; triethylene glycol; and mixtures thereof, and the solvent has a viscosity of from 1.5 to 15,000 mPa·s, is also known.

It has been found that the diols of Formula I are better performing solvents in fluid detergent products. Specifically, it has been found that the diols of Formula I perform better than many existing solvents used in detergent formulations and surfactant pastes, such as 1,2-propylene glycol and dipropylene glycol.

SUMMARY

The present disclosure attempts to solve one more of the needs by providing a composition consisting of or consisting essentially of from about 30% to about 75% by weight of an anionic surfactant selected from the group consisting of linear or branched alkyl sulfates, linear or branched alkoxylated alkyl sulfates, and mixtures thereof, from about 3% to about 18% of a solvent of formula (I)

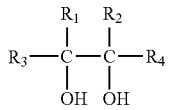

(I)

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, and water.

The present disclosure also relates to a composition consisting essentially of from about 30% to about 75% by weight of an anionic surfactant selected from the group consisting of linear or branched alkyl sulfates, linear or branched alkoxylated alkyl sulfates, and mixtures thereof, from about 3% to about 18% of a primary solvent of formula (I)

(I)

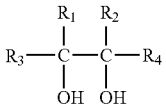

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, from about 0.1% to about 18% of a secondary solvent selected from the group consisting of a monoalcohol of formula (II)

(II)

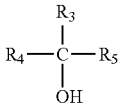

where each of $R_3$, $R_4$, and $R_5$ is independently selected from H or a substituted or unsubstituted, linear or branched $C_1$-$C_6$ alkyl group, glycerine, propoxylated glycerine, ethoxylated glycerine, 1,2-propylene glycol, diethylene glycol, dipropylene glycol, and mixtures thereof, and water.

The present disclosure also relates to a process for manufacturing a aqueous liquid or gel-form laundry detergent comprising the steps of: (i) at a first location, preparing a shippable anionic surfactant paste consisting of or consisting essentially of: from about 30% to about 75% by weight of an anionic surfactant selected from the group consisting of linear or branched alkyl sulfates, linear or branched alkoxylated alkyl sulfates, and mixtures thereof, from about 3% to about 18% by weight of a solvent of formula (I)

(I)

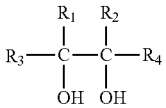

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, where the balance of the paste is water; (ii) shipping the anionic surfactant paste to a second location; (iii) at the second location, adding the anionic surfactant paste to a composition comprising a surfactant and adjuncts.

The present disclosure also relates to a process for manufacturing an aqueous liquid or gel-form laundry detergent comprising the steps of: (i) at a first location, preparing a shippable anionic surfactant paste consisting essentially of: from about 30% to about 75% by weight of an anionic surfactant selected from the group consisting of linear or branched alkyl sulfates, linear or branched alkoxylated alkyl sulfates, and mixtures thereof, from about 3% to about 18% of a primary solvent of formula (I)

(I)

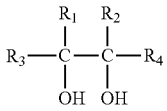

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, from about 0.1% to about 18% of a secondary solvent selected from the group consisting of a monoalcohol of formula (II)

(II)

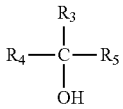

where each of $R_3$, $R_4$, and $R_5$ is independently selected from H or a substituted or unsubstituted, linear or branched $C_1$-$C_6$ alkyl group, glycerine, propoxylated glycerine, ethoxylated glycerine, 1,2-propylene glycol, diethylene glycol, dipropylene glycol, and mixtures thereof, wherein the balance of the paste is water; (ii) shipping the anionic surfactant paste to a second location; (iii) at the second location, adding said anionic surfactant paste to a composition comprising a surfactant and adjuncts.

DETAILED DESCRIPTION

Features and benefits of the present invention will become apparent from the following description, which includes examples intended to give a broad representation of the invention. Various modifications will be apparent to those skilled in the art from this description and from practice of the invention. The scope is not intended to be limited to the particular forms disclosed and the invention covers all modifications, equivalents, and alternatives falling within the spirit and scope of the invention as defined by the claims.

As used herein, the articles including "the," "a" and "an" when used in a claim or in the specification, are understood to mean one or more of what is claimed or described.

As used herein, the terms "include," "includes" and "including" are meant to be non-limiting.

The term "substantially free of" or "substantially free from" as used herein refers to either the complete absence of an ingredient or a minimal amount thereof merely as impurity or unintended byproduct of another ingredient. A composition that is "substantially free" of/from a component means that the composition comprises less than about 0.5%, 0.25%, 0.1%, 0.05%, or 0.01%, or even 0%, by weight of the composition, of the component.

As used herein the phrase "detergent composition" or "cleaning composition" includes compositions and formulations designed for cleaning soiled material. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The detergent compositions may have a form selected from liquid, powder, single-phase or multi-phase unit dose, pouch, tablet, gel, paste, bar, or flake.

As used herein "butanediol" refers to all structural isomers of the diol, including 1,2-butanediol, 1,3-butanediol, 1,4-butanediol, 1,1-butanediol, 2,2-butanediol, and 2,3-butanediol, as well as stereoisomers of the diol. The term "2,3-butanediol" should be interpreted to include all enantiomeric and diastereomeric forms of the compound, including (R,R), (S,S) and meso forms, in racemic, partially stereoisomerically pure or substantially stereoisomerically pure forms. Similarly, the terms "1,2-butanediol," "1,3-butanediol," "1,4-butanediol," "1,1-butanediol," and "2,2-butanediol" should be interpreted to include any and all enantiomeric and diastereomeric forms of the compound, including (R,R), (S,S) and meso forms, in racemic, partially stereoisomerically pure or substantially stereoisomerically pure forms.

As used herein "hexanediol" refers to all structural isomers of the diol as well as stereoisomers of the diol. The term "3,4-hexanediol" should be interpreted to include all enantiomeric and diastereomeric forms of the compound, including (R,R), (S,S) and meso forms, in racemic, partially stereoisomerically pure or substantially stereoisomerically pure forms.

It should be understood that the terms glycerine, glycerol, and glycerin are synonyms and refer to the following molecule:

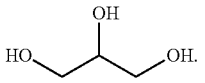

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

It should be understood that the term "comprise" includes also embodiments where the term "comprises" means "consists of" or "consists essentially of."

All cited patents and other documents are, in relevant part, incorporated by reference as if fully restated herein. The citation of any patent or other document is not an admission that the cited patent or other document is prior art with respect to the present invention.

In this description, all concentrations and ratios are on a weight basis of the composition unless otherwise specified.

Anionic Surfactant-Rich Composition

The compositions disclosed herein may be highly concentrated in an anionic surfactant selected from the group consisting of alkyl sulfate surfactant, alkoxylated alkyl sulfate surfactant, and mixtures thereof. The compositions may be premixes (also referred to as surfactant concentrates or pastes) of an anionic surfactant selected from the group consisting of alkyl sulfate surfactant, alkoxylated alkyl sulfate surfactant, and mixtures thereof, and solvent, which can be used to form finished compositions that are suitable for sale to consumers. The compositions may be compact fluid detergents that are suitable for sale to consumers. In particular, pastes and detergent formulations containing hydrophobic anionic surfactants may have disadvantages with regard to physical stability, as these may form undesirable phases resulting in poor consumer experiences and/or difficulties with shippability.

The composition(s) of the present disclosure may comprise, consist of, or consist essentially of at least about 10%, or at least about 20%, or at least about 30%, or at least about 50%, or at least about 60%, or at least about 70%, by weight of the composition, of an anionic surfactant selected from the group consisting of alkyl sulfate surfactant, alkoxylated alkyl sulfate surfactant, and mixtures thereof. The composition(s) of the present disclosure may comprise, consist of, or consist essentially of less than 100%, or less than 90%, or less than about 85%, or less than about 75%, or less than about 70%, by weight of the composition, of an anionic surfactant selected from the group consisting of alkyl sulfate surfactant, alkoxylated alkyl sulfate surfactant, and mixtures thereof. The composition(s) of the present disclosure may comprise, consist of, or consist essentially of from about 10% to about 50%, or about 20% to about 70%, or about 30% to about 75%, or about 30% to about 65%, or about 35% to about 65%, or about 40% to about 60%, by weight of the composition, of an anionic surfactant selected from the group consisting of alkyl sulfate surfactant, alkoxylated alkyl sulfate surfactant, and mixtures thereof. The composition(s) of the present disclosure may consist of or consist essentially of from about 30% to about 70%, or about 30% to about 65%, or about 35% to about 65%, or about 40% to about 60%, by weight of the composition, of an anionic surfactant selected from the group consisting of alkyl sulfate surfactant, alkoxylated alkyl sulfate surfactant, and mixtures thereof.

The alkyl sulfate and/or alkoxylated alkyl sulfate surfactants may exist in an acid form, and the acid form may be neutralized to form a surfactant salt. Typical agents for neutralization include metal counterion bases, such as hydroxides, e.g., NaOH or KOH. Further suitable agents for neutralizing anionic surfactants in their acid forms include ammonia, amines, or alkanolamines. Non-limiting examples of alkanolamines include monoethanolamine, diethanolamine, triethanolamine, and other linear or branched alkanolamines known in the art; suitable alkanolamines include 2-amino-1-propanol, 1-aminopropanol, monoisopropanolamine, or 1-amino-3-propanol. Amine neutralization may be done to a full or partial extent, e.g., part of the anionic surfactant mix may be neutralized with sodium or potassium and part of the anionic surfactant mix may be neutralized with amines or alkanolamines.

Suitable alkyl sulfate and/or alkoxylated alkyl sulfate surfactants may be derived from renewable resources, waste, petroleum, or mixtures thereof. Suitable alkyl sulfate and/or alkoxylated alkyl sulfate surfactants may be linear, partially branched, branched, or mixtures thereof.

Alkoxylated alkyl sulfate materials include ethoxylated alkyl sulfate surfactants (also known as alkyl ether sulfates or alkyl polyethoxylate sulfates) and propoxylated alkyl sulfate surfactants. Examples of alkoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts (included in the term "alkyl" is the alkyl portion of acyl groups). The alkyl group may contain from about 15 carbon atoms to about 30 carbon atoms. The alkoxylated alkyl sulfate surfactant may be a mixture of alkoxylated alkyl sulfates, the mixture having an average (arithmetic mean) carbon chain length within the range of about 12 to about 30 carbon atoms, or an average carbon chain length of about 12 to about 15 carbon atoms, and an average (arithmetic mean) degree of alkoxylation of from about 1 mol to about 4 mols of ethylene oxide, propylene oxide, or mixtures thereof, or an average (arithmetic mean) degree of alkoxylation of about 1.8 mols of ethylene oxide, propylene oxide, or mixtures thereof. The alkoxylated alkyl sulfate surfactant may have a carbon chain length from about 10 carbon atoms to about 18 carbon atoms, and a degree of alkoxylation of from about 0.1 to about 6 mols of ethylene oxide, propylene oxide, or mixtures thereof. The alkoxylated alkyl sulfate may be alkoxylated with ethylene oxide, propylene oxide, or mixtures thereof. Alkyl ether sulfate surfactants may contain a peaked ethoxylate distribution.

Examples of alkyl sulfate (non-alkoxylated, e.g., non-ethoxylated) surfactants include those produced by the sulfation of higher $C_8$-$C_{20}$ fatty alcohols. In some examples, primary alkyl sulfate surfactants have the general formula: $ROSO_3^-M^+$, wherein R is typically a linear $C_8$-$C_{20}$ hydrocarbyl group, which may be straight chain or branched chain, and M is a water-solubilizing cation. In some examples, R is a $C_{10}$-$C_{18}$ alkyl, and M is an alkali metal. In other examples, R is a $C_{12}/C_{14}$ alkyl and M is sodium, such as those derived from natural alcohols.

The alkyl sulfate surfactant or the alkoxylated alkyl sulfate surfactant may include 2-alkyl branched primary alkyl sulfate or 2-alkyl branched alkyl alkoxy sulfate, respectively. 2-alkyl branched alkyl sulfates and 2-alkyl branched alkyl alkoxy sulfates have 100% branching at the C2 position (C1 is the carbon atom covalently attached to the sulfate or alkoxylated sulfate moiety). 2-alkyl branched alkyl sulfates and 2-alkyl branched alkyl alkoxy sulfates are generally derived from 2-alkyl branched alcohols (as hydrophobes). 2-alkyl branched alcohols, e.g., 2-alkyl-1-alkanols or 2-alkyl primary alcohols, which are derived from the oxo process, are commercially available from Sasol, e.g., LIAL®, ISALCHEM® (which is prepared from LIAL® alcohols by a fractionation process).

The alkyl sulfate surfactant may include a mid-chain branched alkyl sulfate.

The paste composition(s) of the present disclosure may comprise, consist of, or consist essentially of from about 30% to about 75% by weight of an anionic surfactant selected from the group consisting of alkyl sulfate surfactant, alkoxylated alkyl sulfate surfactant, and mixtures thereof. The paste composition(s) of the present disclosure may comprise, consist of, or consist essentially of from about 30% to about 75% by weight of an anionic surfactant selected from the group consisting of 2-alkyl branched alkyl sulfates, 2-alkyl branched alkyl alkoxy sulfates, and mixtures thereof. The composition(s) disclosed herein may comprise, consist of, or consist essentially of an anionic surfactant selected from $C_{12}$-$C_{16}$ linear or branched alkoxylated alkyl sulfate or $C_{14}$-$C_{16}$ linear or branched alkoxylated alkyl sulfate.

Solvent

The composition disclosed herein may be a premix of an anionic surfactant and solvent (also referred to as a surfactant paste or a surfactant concentrate or a concentrated surfactant paste), which can be used to form a finished composition that is suitable for sale to consumers.

The paste or detergent compositions of the disclosure may be substantially free of a diol having only terminal hydroxyl groups. The paste or detergent compositions of the disclosure may be substantially free of a diol having only terminal hydroxyl groups, where the distance between the hydroxyl groups is 3 carbon atoms. The paste or detergent compositions of the disclosure may be substantially free of 1,3-propanediol and 2-methyl-1,3-propanediol.

The composition(s) of the present disclosure may contain a solvent of formula (I):

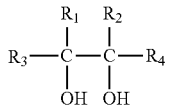

(I)

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group. It has been found that a fluid, anionic surfactant-rich composition containing a solvent of formula (I) exhibits improved stability. In addition, these solvents are more efficient than known solvents and have relatively high flash points, as compared to known solvents.

Without being bound by theory, it is believed that the diol(s) of formula (I) are better solvents for aqueous surfactant pastes and aqueous detergents that contain hydrophobic anionic surfactants. Conventional solvents, such as 1,2-propylene glycol and dipropylene glycol, are believed to be more hydrophilic than the diol(s) of formula (I). It is believed that the diol(s) of formula (I) have a desirable hydrophobic/hydrophilic balance for use in aqueous detergents containing hydrophobic anionic surfactants. Also, for example, 1,4-butanediol, which only has terminal hydroxyl groups, has inferior solvent performance, versus the diol(s) of formula (I).

The solvent may be selected from the group consisting of 2,3-butanediol, 1,2-butanediol, 3,3-dimethyl-1,2-butanediol, 3,4-hexanediol, structural isomers thereof, stereoisomers thereof, and mixtures thereof.

2,3-butanediol may be produced by microbial fermentation of carbohydrate containing feedstock. 2,3-butanediol may also be produced by microbial fermentation of biomass from crops such as sugar beet, corn, wheat and sugarcane. However, the cost of these carbohydrate feed stocks is influenced by their value as human food or animal feed and the cultivation of starch or sucrose-producing crops for 2,3-butanediol production is not economically sustainable in all geographies. More recently, methods of producing 2,3-butanediol via the anaerobic fermentation of a substrate comprising carbon monoxide or carbon monoxide and hydrogen by one or more carboxydotrophic acetogenic bacteria have been disclosed by LanzaTech (See U.S. Pat. No. 8,673,603 B2). LanzaTech's gas fermentation process converts carbon-rich waste gases (containing carbon monoxide, carbon dioxide, and/or hydrogen) into biofuels and chemicals, such as 2,3-butanediol.

2,3-butanediol may also be derived by catalytic hydrogenation of sugars, such as glucose, or reduced sugars, such as sorbitol. This process produces a mixture of stereoisomers of 2,3-butanediol as well other structural isomers, such as 1,2-butanediol. Cellulosic sugars may also be a feedstock.

The various processes of making 2,3-butanediol may produce various impurities and/or contaminants. Possible impurities include 2-methyl-1,2-propanediol, 1,2-butanediol, 2-hydroxy-2-butanone, acetoin, butadiene, methyl ethyl ketone, or mixtures thereof. Other impurities may also be present.

The composition(s) of the present disclosure may comprise, consist of, or consist essentially of from about 2%, or from about 3%, or from about 4%, or from about 6% to about 10%, or to about 12%, or to about 14%, or to about 18%, or to about 20%, or from about 3% to about 18%, or from about 6% to about to about 14% of a solvent selected from the group consisting of 2,3-butanediol, 1,2-butanediol, 1,3-butanediol, and mixtures thereof.

Secondary Solvent

The compositions described herein may contain an additional, secondary solvent in addition to the primary solvent of formula (I). The secondary solvent may be selected from the group consisting of a monoalcohol of formula (II)

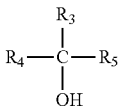

(II)

where each of $R_3$, $R_4$, and $R_5$ is independently selected from H or a substituted or unsubstituted, linear or branched $C_1$-$C_6$ alkyl group, glycerine, propoxylated glycerine, ethoxylated glycerine, 1,2-propylene glycol, diethylene glycol, dipropylene glycol, renewable versions thereof (e.g., renewable 1,2-propylene glycol, renewable dipropylene glycol), other solvents used in detergent formulation, and mixtures thereof. Examples of substituted $C_1$-$C_6$ alkyl groups in formula I include methoxy ethyl, methoxy propyl, and methoxy ethoxy propyl.

The composition(s) of the present disclosure may comprise, consist of, or consist essentially of from about 0.05%, or from about 0.1%, or from about 1%, or from about 3%, or from about 5% to about 10%, or to about 12%, or to about 14%, or to about 18%, or to about 20%, or from about 0.1% to about 18%, or from about 3% to about to about 14% of a secondary solvent selected from the group consisting of a monoalcohol of formula (II)

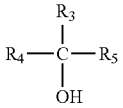

(II)

where each of $R_3$, $R_4$, and $R_5$ is independently selected from H or a substituted or unsubstituted, linear or branched $C_1$-$C_6$ alkyl group, glycerine, propoxylated glycerine, ethoxylated glycerine, 1,2-propylene glycol, diethylene glycol, dipropylene glycol, renewable versions thereof, and mixtures thereof.

Water

The composition may comprise from about 1% to about 80%, by weight of the composition, water. When the composition is a heavy duty liquid detergent composition, the composition may comprise from about 40% to about 80% water. When the composition is a compact liquid detergent, the composition may comprise from about 20% to about 60%, or from about 30% to about 50% water. When the composition is in unit dose form, for example, encapsulated in water-soluble film, the composition may comprise less than about 20%, or less than about 15%, or less than about 12%, or less than about 10%, or less than about 8%, or less than about 5% water. The composition may comprise from about 1% to about 20%, or from about 3% to about 15%, or from about 5% to about 12%, by weight of the composition, of water.

Finished Detergent Composition

The present disclosure also relates to a finished detergent composition(s) comprising the alkyl sulfate and/or alkoxylated alkyl sulfate surfactant paste described above, optionally, an additional surfactant, and an adjunct. The finished detergent composition may be encapsulated within a water-soluble film, for example, a film comprising polyvinyl alcohol (PVOH).

The finished detergent composition may be a form selected from the group consisting of a liquid laundry detergent, a gel detergent, a single-phase or multi-phase unit dose detergent, a detergent contained in a single-phase or multi-phase or multi-compartment water soluble pouch, a liquid hand dishwashing composition, a laundry pretreat product, fabric softener composition, and mixtures thereof.

Suitable additional surfactants include other anionic surfactants, nonionic surfactants, cationic surfactants, zwitterionic surfactants, amphoteric surfactants, and ampholytic surfactants.

Other anionic surfactants include methyl ester sulfonates, paraffin sulfonates, α-olefin sulfonates, and internal olefin sulfonates.

Other anionic surfactants also include the alkali metal salts of alkyl benzene sulfonates, in which the alkyl group contains from about 9 to about 15 carbon atoms, in straight chain (linear) or branched chain configuration. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS.

Suitable alkyl benzene sulphonate (LAS) may be obtained, by sulphonating commercially available linear alkyl benzene (LAB); suitable LAB includes low 2-phenyl LAB, such as those supplied by Sasol under the tradename Isorchem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable. In one aspect a magnesium salt of LAS is used.

Another example of a suitable alkyl benzene sulfonate is a modified LAS (MLAS), which is a positional isomer that contains a branch, e.g., a methyl branch, where the aromatic ring is attached to the 2 or 3 position of the alkyl chain.

Suitable nonionic surfactants include alkoxylated fatty alcohols. The nonionic surfactant may be selected from ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15.

Other non-limiting examples of nonionic surfactants useful herein include: $C_8$-$C_{18}$ alkyl ethoxylates, such as, NEODOL® nonionic surfactants from Shell; $C_6$-$C_{12}$ alkyl phenol alkoxylates where the alkoxylate units may be ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA; $C_{14}$-$C_{22}$ mid-chain branched alkyl alkoxylates, $BAE_x$, wherein x is from 1 to 30; alkylpolysaccharides; specifically alkylpolyglycosides; polyhydroxy fatty acid amides; and ether capped poly(oxyalkylated) alcohol surfactants.

Suitable nonionic detersive surfactants also include alkyl polyglucoside and alkyl alkoxylated alcohol. Suitable nonionic surfactants also include those sold under the tradename Lutensol® from BASF.

Non-limiting examples of cationic surfactants include: the quaternary ammonium surfactants, which can have up to 26 carbon atoms include: alkoxylate quaternary ammonium (AQA) surfactants; dimethyl hydroxyethyl quaternary ammonium; dimethyl hydroxyethyl lauryl ammonium chloride; polyamine cationic surfactants; cationic ester surfactants; and amino surfactants, e.g., amido propyldimethyl amine (APA).

Suitable cationic detersive surfactants also include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, suitable anions include: halides, for example chloride; sulphate; and sulphonate. Suitable cationic detersive surfactants are mono-$C_{6-18}$ alkyl mono-hydroxyethyl di-methyl quaternary ammonium chlorides. Highly suitable cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. Suitable examples of zwitterionic surfactants include betaines, including alkyl dimethyl betaine and cocodimethyl amidopropyl betaine, $C_8$ to $C_{18}$ (for example from $C_{12}$ to $C_{18}$) amine oxides, and sulfo and hydroxy betaines, such as N-alkyl-N,N-dimethylammino-1-propane sulfonate where the alkyl group can be $C_8$ to $C_{18}$.

Examples of amphoteric surfactants include aliphatic derivatives of secondary or tertiary amines, or aliphatic derivatives of heterocyclic secondary and tertiary amines in which the aliphatic radical may be straight or branched-chain and where one of the aliphatic substituents contains at least about 8 carbon atoms, or from about 8 to about 18 carbon atoms, and at least one of the aliphatic substituents contains an anionic water-solubilizing group, e.g. carboxy, sulfonate, sulfate. Suitable amphoteric surfactants also include sarcosinates, glycinates, taurinates, and mixtures thereof.

It is understood that surfactants are generally not single compounds, as may be suggested by their general formulas, for example: $ROSO_3^-M^+$, $R(OC_2H_4)_nOSO_3H$, $R(OC_2H_4)_nOH$

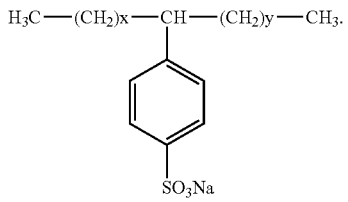

Rather, surfactants may be made up of a blend of molecules having different alkyl chain lengths (though it is possible to obtain single chain-length cuts). Alkoxylated surfactants may be made up of a blend of molecules having varied polyalkylene oxide chain lengths. Some surfactants, such as 2-alkyl branched alkyl sulfates, may be made up of a mixture of positional isomers. Surfactants may contain various impurities, as well.

The adjunct may be selected from the group consisting of a structurant, a builder, an organic polymeric compound, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, and mixtures thereof. The finished detergent composition may comprise from about 0.001% to about 1% by weight of an enzyme (as an adjunct), which may be selected from the group consisting of lipase, amylase, protease, mannanase, cellulase, pectinase, and mixtures thereof.

The adjunct may be selected from the group consisting of a structurant, a builder, a fabric softening agent, a polymer or an oligomer, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, and mixtures thereof.

Additional suitable adjuncts include other active ingredients, carriers, hydrotropes, processing aids, dyes or pigments, solvents for liquid formulations, and solid or other liquid fillers, erythrosine, colliodal silica, waxes, probiotics, surfactin, aminocellulosic polymers, Zinc Ricinoleate, perfume microcapsules, rhamnolipids, sophorolipids, glycopeptides, methyl ester sulfonates, methyl ester ethoxylates, sulfonated estolides, cleavable surfactants, biopolymers, silicones, modified silicones, aminosilicones, deposition aids, locust bean gum, cationic hydroxyethylcellulose polymers, cationic guars, hydrotropes (especially cumenesulfonate salts, toluenesulfonate salts, xylenesulfonate salts, and naphalene salts), antioxidants, BHT, PVA particle-encapsulated dyes or perfumes, pearlescent agents, effervescent agents, color change systems, silicone polyurethanes, opacifiers, tablet disintegrants, biomass fillers, fast-dry silicones, glycol distearate, hydroxyethylcellulose polymers, hydrophobically modified cellulose polymers or hydroxyethylcellulose polymers, starch perfume encapsulates, emulsified oils, bisphenol antioxidants, microfibrous cellulose structurants, properfumes, styrene/acrylate polymers, triazines, soaps, superoxide dismutase, benzophenone protease inhibitors, functionalized TiO2, dibutyl phosphate, silica perfume capsules, and other adjunct ingredients, silicate salts (e.g., sodium silicate, potassium silicate), choline oxidase, pectate lyase, mica, titanium dioxide coated mica, bismuth oxychloride, and other actives.

The detergent compositions described herein may also contain vitamins and amino acids such as: water soluble vitamins and their derivatives, water soluble amino acids and their salts and/or derivatives, water insoluble amino acids viscosity modifiers, dyes, nonvolatile solvents or diluents (water soluble and insoluble), pearlescent aids, foam boosters, additional surfactants or nonionic cosurfactants, pediculocides, pH adjusting agents, perfumes, preservatives, chelants, proteins, skin active agents, sunscreens, UV absorbers, vitamins, niacinamide, caffeine, and minoxidil.

The detergent compositions of the present invention may also contain pigment materials such as nitroso, monoazo, disazo, carotenoid, triphenyl methane, triaryl methane, xanthene, quinoline, oxazine, azine, anthraquinone, indigoid, thionindigoid, quinacridone, phthalocianine, botanical, and natural colors, including water soluble components such as those having C.I. Names. The detergent compositions of the present invention may also contain antimicrobial agents.

Method of Making a Concentrated Surfactant Paste

The concentrated surfactant paste(s) disclosed herein may be produced by combining from about 30% to about 75% by weight of an anionic surfactant selected from the group consisting of linear or branched alkyl sulfates, linear or branched alkoxylated alkyl sulfates, and mixtures thereof, from about 3% to about 18% or from about 6% to about 14% by weight of a solvent of formula (I)

(I)

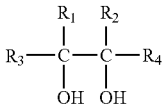

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, where the balance of the paste is water. It is understood by one skilled in the art that anionic surfactants are neutralized and the paste may therefore also contain a base, such as NaOH, KOH, and mixtures of these and other bases. The concentrated surfactant paste(s) may be made in either a batch or a continuous process.

The concentrated surfactant paste(s) disclosed herein may be produced by combining from about 30% to about 75% by weight of an anionic surfactant selected from the group consisting of linear or branched alkyl sulfates, linear or branched alkoxylated alkyl sulfates, and mixtures thereof, from about 3% to about 18% or from about 6% to about 14% by weight of a primary solvent of formula (I)

(I)

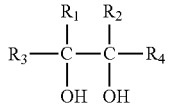

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, from about 0.1% to about 18% by weight of a secondary solvent selected from the group consisting of a monoalcohol of formula (II)

(II)

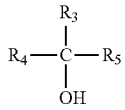

wherein each of $R_3$, $R_4$, and $R_5$ is independently selected from H or a substituted or unsubstituted, linear or branched $C_1$-$C_6$ alkyl group, glycerine, propoxylated glycerine, ethoxylated glycerine, 1,2-propylene glycol, diethylene glycol, dipropylene glycol, and mixtures thereof, where the balance of the paste is water. It is understood by one skilled in the art that anionic surfactants are neutralized and the paste may therefore also contain a base, such as NaOH, KOH, and mixtures of these and other bases. The concentrated surfactant paste(s) may be made in either a batch or a continuous process.

Method of Making a Detergent Composition

A process for manufacturing an aqueous liquid or gel-form laundry detergent may comprise the steps of: (i) at a first location, preparing a shippable anionic surfactant paste consisting of or consisting essentially of: from about 30% to about 75% by weight of an anionic surfactant selected from the group consisting of linear or branched alkyl sulfates, linear or branched alkoxylated alkyl sulfates, and mixtures thereof, from about 3% to about 18% or from about 6% to about 14% by weight of a solvent of formula (I)

(I)

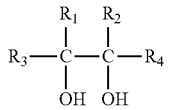

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, where the balance of the paste is water; (ii) shipping the anionic surfactant paste to a second location; (iii) at the second location, adding the anionic surfactant paste to a composition comprising a surfactant and adjuncts.

A process for manufacturing an aqueous liquid or gel-form laundry detergent may comprise the steps of: (i) at a first location, preparing a shippable anionic surfactant paste consisting of or consisting essentially of: from about 30% to about 75% by weight of an anionic surfactant selected from the group consisting of linear or branched alkyl sulfates, linear or branched alkoxylated alkyl sulfates, and mixtures thereof, from about 3% to about 18% or from about 6% to about 14% by weight of a primary solvent of formula (I)

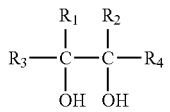

(I)

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, from about 0.1% to about 18% by weight of a secondary solvent selected from the group consisting of a monoalcohol of formula (II)

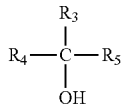

(II)

wherein each of $R_3$, $R_4$, and $R_5$ is independently selected from H or a substituted or unsubstituted, linear or branched $C_1$-$C_6$ alkyl group, glycerine, propoxylated glycerine, ethoxylated glycerine, 1,2-propylene glycol, diethylene glycol, dipropylene glycol, and mixtures thereof, where the balance of the paste is water; (ii) shipping the anionic surfactant paste to a second location; (iii) at the second location, adding the anionic surfactant paste to a composition comprising a surfactant and adjuncts.

Methods of Use

The present invention includes methods for cleaning soiled material. Compact fluid detergent compositions that are suitable for sale to consumers are suited for use in laundry pretreatment applications, laundry cleaning applications, and home care applications.

Such methods include, but are not limited to, the steps of contacting detergent compositions in neat form or diluted in wash liquor, with at least a portion of a soiled material and then optionally rinsing the soiled material. The soiled material may be subjected to a washing step prior to the optional rinsing step.

For use in laundry pretreatment applications, the method may include contacting the detergent compositions described herein with soiled fabric. Following pretreatment, the soiled fabric may be laundered in a washing machine or otherwise rinsed.

Machine laundry methods may comprise treating soiled laundry with an aqueous wash solution in a washing machine having dissolved or dispensed therein an effective amount of a machine laundry detergent composition in accord with the invention. An "effective amount" of the detergent composition means from about 20 g to about 300 g of product dissolved or dispersed in a wash solution of volume from about 5 L to about 65 L. The water temperatures may range from about 5° C. to about 100° C. The water to soiled material (e.g., fabric) ratio may be from about 1:1 to about 30:1. The compositions may be employed at concentrations of from about 500 ppm to about 15,000 ppm in solution. In the context of a fabric laundry composition, usage levels may also vary depending not only on the type and severity of the soils and stains, but also on the wash water temperature, the volume of wash water, and the type of washing machine (e.g., top-loading, front-loading, vertical-axis Japanese-type automatic washing machine).

The detergent compositions herein may be used for laundering of fabrics at reduced wash temperatures. These methods of laundering fabric comprise the steps of delivering a laundry detergent composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted to the water prior to, or after, or simultaneous with, contacting the laundry detergent composition with water.

Another method includes contacting a nonwoven substrate, which is impregnated with the detergent composition, with a soiled material. As used herein, "nonwoven substrate" can comprise any conventionally fashioned nonwoven sheet or web having suitable basis weight, caliper (thickness), absorbency, and strength characteristics. Non-limiting examples of suitable commercially available nonwoven substrates include those marketed under the tradenames SONTARA® by DuPont and POLYWEB® by James River Corp.

Hand washing/soak methods, and combined handwashing with semi-automatic washing machines, are also included.

Packaging for the Compositions

The compact fluid detergent compositions that are suitable for consumer use can be packaged in any suitable container including those constructed from paper, cardboard, plastic materials, and any suitable laminates. The compact fluid detergent compositions may also be encapsulated in water-soluble film and packaged as a unitized dose detergent composition, for example, mono-compartment pouches or multi-compartment pouches having superposed and/or side-by-side compartments.

Specific contemplated aspects of the disclosure are herein described in the following numbered paragraphs.

1. A composition consisting essentially of from about 30% to about 75% by weight of an anionic surfactant selected from the group consisting of linear or branched alkyl sulfates, linear or branched alkoxylated alkyl sulfates, and mixtures thereof, from about 3% to about 18%, preferably from about 6% to about 14%, of a solvent of formula (I)

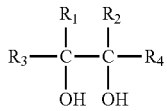

(I)

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, and water.

2. A composition consisting essentially of from about 30% to about 75% by weight of an anionic surfactant selected from the group consisting of linear or branched alkyl sulfates, linear or branched alkoxylated alkyl sulfates, and mixtures thereof, from about 3% to about 18%, preferably from about 6% to about 14%, of a primary solvent of formula (I)

(I)

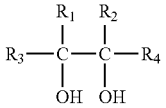

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, from about 0.1% to about 18% of a secondary solvent selected from the group consisting of a monoalcohol of formula (II)

(II)

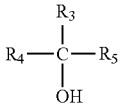

wherein each of $R_3$, $R_4$, and $R_5$ is independently selected from H or a substituted or unsubstituted, linear or branched $C_1$-$C_6$ alkyl group, glycerine, propoxylated glycerine, ethoxylated glycerine, 1,2-propylene glycol, diethylene glycol, dipropylene glycol, and mixtures thereof, and water. The laundry detergent composition 3. The composition of any of the preceding paragraphs wherein said composition is substantially free of a diol having only terminal hydroxyl groups.

4. The composition of any of the preceding paragraphs wherein said composition is substantially free of a diol having only terminal hydroxyl groups, the distance between said terminal hydroxyl groups being 3 carbon atoms.

5. The composition of any of the preceding paragraphs wherein said composition is substantially free of 1,3-propanediol and 2-methyl-1,3-propanediol.

6. The composition of any of the preceding paragraphs wherein said anionic surfactant is $C_{12}$-$C_{16}$ linear or branched alkoxylated alkyl sulfate, preferably $C_{14}$-$C_{16}$ linear or branched alkoxylated alkyl sulfate.

7. The composition of any of the preceding paragraphs wherein said anionic surfactant is selected from the group consisting of 2-alkyl branched primary alkyl sulfates.

8. A detergent composition comprising the composition of any of the preceding paragraphs and an adjunct.

9. The detergent composition of paragraph 8 wherein said adjunct is selected from the group consisting of a structurant, a builder, a fabric softening agent, a polymer or an oligomer, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, and mixtures thereof.

10. The detergent composition of paragraph 9 wherein said detergent composition comprises an enzyme selected from the group consisting of lipase, amylase, protease, mannanase, cellulase, pectinase, and mixtures thereof.

11. The detergent composition of paragraph 9 wherein said detergent composition comprises from about 0.001% to about 1% by weight of enzyme.

12. The detergent composition of paragraph 8 wherein said detergent composition is a form selected from the group consisting of a liquid laundry detergent, a gel detergent, a single-phase or multi-phase unit dose detergent, a detergent contained in a single-phase or multi-phase or multi-compartment water-soluble pouch, a liquid hand dishwashing composition, a laundry pretreat product, a fabric softener composition, and mixtures thereof.

13. The detergent composition of paragraph 8 wherein said detergent composition comprises less than about 20% water.

14. The detergent composition of paragraph 12 wherein said detergent composition is a detergent contained in a single-phase or multi-phase or multi-compartment water-soluble pouch.

15. A process for manufacturing an aqueous liquid or gel-form laundry detergent comprising the steps of:

(i) at a first location, preparing a shippable anionic surfactant paste consisting essentially of: from about 30% to about 75%, by weight of an anionic surfactant selected from the group consisting of linear or branched alkyl sulfates, linear or branched alkoxylated alkyl sulfates, and mixtures thereof, from about 3% to about 18%, preferably from about 6% to about 14%, of a solvent of formula (I)

(I)

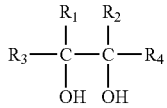

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, wherein the balance of said paste is water;

(ii) shipping the anionic surfactant paste to a second location;

(iii) at the second location, adding said anionic surfactant paste to a composition comprising a surfactant and adjuncts.

16. A process for manufacturing an aqueous liquid or gel-form laundry detergent comprising the steps of:

(i) at a first location, preparing a shippable anionic surfactant paste consisting essentially of: from about 30% to about 75% by weight of an anionic surfactant selected from the group consisting of linear or branched alkyl sulfates, linear or branched alkoxylated alkyl sulfates, and mixtures thereof, from about 3% to about 18%, preferably from about 6% to about 14%, by weight of a primary solvent of formula (I)

(I)

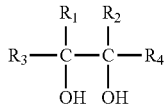

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, from about 0.1% to about 18% of a secondary solvent selected from the group consisting of a monoalcohol of formula (II)

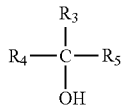

(II)

wherein each of $R_3$, $R_4$, and $R_5$ is independently selected from H or a substituted or unsubstituted, linear or branched $C_1$-$C_6$ alkyl group, glycerine, propoxylated glycerine, ethoxylated glycerine, 1,2-propylene glycol, diethylene glycol, dipropylene glycol, and mixtures thereof, wherein the balance of the paste is water;

(ii) shipping the anionic surfactant paste to a second location;

(iii) at the second location, adding said anionic surfactant paste to a composition comprising a surfactant and adjuncts.

17. The process of paragraph 15 or paragraph 16 wherein said shippable anionic surfactant paste is substantially free of a diol having only terminal hydroxyl groups.

18. The process of paragraph 15 or paragraph 16 wherein said shippable anionic surfactant paste is substantially free of a diol having only terminal hydroxyl groups, the distance between said terminal hydroxyl groups being 3 carbon atoms.

19. The process of paragraph 15 or paragraph 16 wherein said shippable anionic surfactant paste is substantially free of 1,3-propanediol and 2-methyl-1,3-propanediol.

20. The process of paragraph 15 or paragraph 16 wherein said anionic surfactant is $C_{12}$-$C_{16}$ linear or branched alkoxylated alkyl sulfate, preferably $C_{14}$-$C_{16}$ linear or branched alkoxylated alkyl sulfate.

21. The process of paragraph 15 or paragraph 16 wherein said anionic surfactant is selected from the group consisting of 2-alkyl branched primary alkyl sulfates.

EXAMPLES

Example 1

Surfactant Paste Samples

Test samples are prepared by standard methods of mixing in a container and, if necessary, are neutralized to pH above 7 and less than 9 for sufficient stability of sulfated surfactants. Sample size is sufficient for accurate weighing of components. Reference samples are matched to samples containing the solvents disclosed herein and placed in a controlled temperature storage room of either 40° C. or 20° C. for periods ranging from 1 week to 4 weeks with periodic visual assessment of the physical state of the sample.

Analysis

Samples are visually evaluated as either passing or failing. Passing samples are visually clear, homogeneous, with no substantial haze or precipitate, and free flowing, when the container is inverted. Failing samples are substantially hazy, have more than one phase (e.g., two distinct visible layers), contain some visible precipitate, or form a gel (semi-solid single layer) that does not flow upon inversion of the container. For example, samples that are free flowing but have more than one phase are evaluated as failing.

The results below in Example 1 are visually evaluated as passing or failing, based on the criteria discussed above.

Example 1

Comparison of solvent containing 2,3-butanediol (purchased from Sigma Aldrich) and ethanol or glycerine versus solvent containing 1,2-propylene glycol (PG) or dipropylene glycol (DPG) and ethanol or glycerine (ethanol/glycerine concentrations held constant between the data sets that are compared), measured as percent reduction over 1,2-propylene glycol (PG) or dipropylene glycol (DPG), with water added as balance of components.

TABLE 1

| Surfactant | Solvent | Surfactant Concentration | % solvent level reduction over PG | % solvent level reduction over DPG |
|---|---|---|---|---|
| C25 AE1.8S[1] | 2,3-BDO | 53% | 30% | 30% |
| C45 AE2.5S[2] | 2,3-BDO | 53% | 30% | 30% |
| sodium 2-alkylbranched alcohol sulfate[3] | 2,3-BDO | 37% | 15% | 15% |
| AES[4]:LAS[5] ratio = 1.7:1.0 | 2,3-BDO | 50% | 20% | 20% |
| AES:LAS ratio 1.0:2.0 | 2,3-BDO | 33% | 20% | 20% |
| AES:LAS ratio = 1.7:1.0 | 2,3-BDO | 50% | 15% | 15% |
| C25 AE1.8S[1] | 1,4-BDO | 53% | 0% | 0% |
| C25 AE1.8S[1] | 1,3-propane diol | 53% | 0% | 0% |
| C25 AE1.8S[1] | 85/15 mixture 2,3-BDO and 1,2-BDO | 53% | 30% | 30% |
| C25 AE1.8S[1] | (2R,3R)-(−)-2,3-Butanediol | 53% | 30% | 30% |

[1]C25 AE1.8S is $C_{12-15}$ alkyl ethoxy (1.8) sulfate.

[2]C45 AE2.5S is $C_{14-15}$ alkyl ethoxy (2.5) sulfate.

[3]Sodium C14, 15, 16 2-alkylbranched alcohol sulfate is Isalchem ® 156 AS.

[4]AES is $C_{12-15}$ alkyl ethoxy (1.8) sulfate, supplied by P&G, Cincinnati, OH, USA.

[5]LAS is linear alkylbenzenesulfonate having an average aliphatic carbon chain length between $C_{11}$ and $C_{12}$, supplied by Stepan, Northfield, Illinois, USA or Huntsman Corp. HLAS is acid form.

Example 2

Comparison of solvent containing 2,3-butanediol, pure R,R isomer 2,3-butanediol, 1,2-butanediol, 85:15 blend of 2,3-butanediol and 1,2-butanediol, 3,3-dimethyl-1,2-butanediol, or 3,4-hexanediol in combination with ethanol versus solvent containing 1,2-propylene glycol, 1,3-propylene glycol, or 1,4-propylene glycol in combination with ethanol (ethanol concentrations held constant between the data sets that are compared), measured as the concentration of solvent that achieves stability in a paste containing 53% A25E1.8S at 40° C., with water added as balance of components.

TABLE 2

| Solvent | 40° C. stability 53% AES paste |
|---|---|
| 1,2-propylene glycol | 12% |
| 1,3-propylene glycol | 12% |
| 1,4-propylene glycol | 12% |
| 2,3-butanediol racemic | 8% |
| RR pure isomer 2,3-butanediol | 8% |
| 1,2-butanediol | 10% |
| Blend 80:20 2,3-butanediol and 1,2-butanediol | 8% |
| 3,3-dimethyl-1,2-butanediol | 8% |
| 3,4-hexanediol | 6% |

Detergent Formulation Examples

Example 3

Heavy Duty Liquid Laundry Detergent Compositions

TABLE 3

| | (wt %) | (wt %) | (wt %) | (wt %) | (wt %) | (wt %) | (wt %) |
|---|---|---|---|---|---|---|---|
| 2,3-butanediol | 1.5 | 3 | 2 | 3 | 2 | 3 | 0 |
| 1,2-butanediol | 0.5 | 1 | 1 | 3 | 1 | 0 | 0 |
| 3,4-hexanediol | 0 | 0 | 0 | 0 | 0 | 0 | 3 |
| Ethanol | 1.1 | 2 | 2 | 0 | 2 | 2 | 1 |
| Diethylene glycol | 0 | 1 | 0 | 0 | 0 | 0 | 0 |
| 1,2-Propanediol | 1.7 | 0 | 2 | 0 | 3 | 3 | 1 |
| Dipropylene glycol | 0 | 0 | 0 | 0 | 0 | 0 | 0 |
| Glycerine | 0 | 0 | 0 | 0.1 | 0 | 0.1 | 0 |
| Sodium cumene sulphonate | 0 | 0 | 0 | 2 | 0 | 1 | 0 |
| MES | 0 | 0 | 0 | 0 | 4 | 0 | 0 |
| AES | 9 | 17 | 3 | 2 | 1 | 15 | 15 |
| LAS | 1.5 | 7 | 15 | 6 | 4 | 4 | 4 |
| HSAS | 0 | 3 | 0 | 0 | 0 | 0 | 0 |
| Isalchem ® 156 AS | 0 | 0 | 0 | 12 | 0 | 0 | 0 |
| AE | 0 | 0.6 | 3 | 4 | 1 | 6 | 1 |
| Lauryl Trimethyl Ammonium Chloride | 0 | 1 | 0.5 | 0.25 | 0 | 0 | 0 |
| $C_{12-14}$ dimethyl Amine Oxide | 0.3 | 2 | 0.23 | 0 | 0 | 0 | 1 |
| Sodium formate | 1.6 | 0.09 | 1.2 | 1.6 | 0 | 0.2 | 0.2 |
| Calcium formate | 0 | 0 | 0 | 0 | 0.13 | 0 | 0 |
| Calcium Chloride | 0.01 | 0.08 | 0 | 0 | 0 | 0 | 0 |
| Monoethanolamine | 1.4 | 1.0 | 4.0 | 0 | 0 | To pH 8.2 | 0 |
| Diethylene glycol | 5.5 | 0.0 | 4.1 | 0.7 | 0 | 0 | 0 |
| Chelant | 0.15 | 0.15 | 0.11 | 0.5 | 0.11 | 0.8 | 0.11 |
| Citric Acid | 2.5 | 3.96 | 1.88 | 0.9 | 2.5 | 0.6 | 0.9 |
| $C_{12-18}$ Fatty Acid | 0.8 | 3.5 | 0.6 | 1.2 | 0 | 15.0 | 1.2 |
| 4-formyl-phenylboronic acid | 0 | 0 | 0 | 0.1 | 0.02 | 0.01 | 0 |
| Borax | 1.43 | 2.1 | 1.1 | 0 | 1.07 | 0 | 1.1 |
| Ethoxylated Polyethylenimine | 0 | 1.4 | 0 | 0 | 0 | 0.8 | 1.4 |
| Zwitterionic ethoxylated quaternized sulfated hexamethylene diamine | 2.1 | 0 | 0.7 | 0.3 | 1.6 | 0 | 0 |
| PEG-PVAc Polymer | 0.1 | 0.2 | 0.0 | 0.05 | 0.0 | 1 | 0.2 |
| Grease Cleaning Alkoxylated Polyalkylenimine Polymer | 1 | 2 | 0 | 1.5 | 0 | 0 | 1 |
| Fluorescent Brightener | 0.2 | 0.1 | 0.05 | 0.15 | 0.3 | 0.2 | 0.1 |
| Hydrogenated castor oil derivative structurant | 0.1 | 0 | 0.4 | 0 | 0 | 0.1 | 0.1 |
| Perfume | 1.6 | 1.1 | 1.0 | 0.9 | 1.5 | 1.6 | 1.0 |
| Core Shell Melamine-formaldehyde encapsulate of perfume | 0.5 | 0.05 | 0.00 | 0.1 | 0.05 | 0.1 | 0.1 |
| Protease (40.6 mg active/g) | 0.8 | 0.6 | 0.7 | 0.7 | 0.2 | 1.5 | 0.7 |
| Mannanase: Mannaway ® (25 mg active/g) | 0.07 | 0.05 | 0 | 0.04 | 0.045 | 0.1 | 0 |
| Amylase: Stainzyme ® (15 mg active/g) | 0.3 | 0 | 0.3 | 0 | 0.6 | 0.1 | 0.6 |
| Amylase: Natalase ® (29 mg active/g) | 0 | 0.6 | 0.1 | 0.07 | 0 | 0.1 | 0 |
| Xyloglucanase (Whitezyme ®, 20 mg active/g) | 0.2 | 0.1 | 0 | 0.05 | 0.05 | 0.2 | 0 |
| Lipex ® (18 mg active/g) | 0.4 | 0.2 | 0.3 | 0.2 | 0 | 0 | 0.2 |
| *Water, dyes & minors | | | Balance | | | | |

*Based on total cleaning and/or treatment composition weight

All enzyme levels are expressed as % enzyme raw material.

Example 4

Unit Dose Compositions

Unit dose laundry detergent formulations can comprise one or multiple compartments.

TABLE 4

| Ingredient | (wt %) | (wt %) | (wt %) | (wt %) | (wt %) | (wt %) |
|---|---|---|---|---|---|---|
| 2,3-butanediol | 4 | 2.5 | 0 | 3 | 4 | 0 |
| 1,2-butanediol | 0 | 2.5 | 0 | 1 | 2 | 0 |
| (2R,3R)-(−)-2,3-Butanediol | 0 | 0 | 3 | 0 | 0 | 0 |
| 3,4-hexanediol | 0 | 0 | 0 | 0 | 0 | 4 |
| 1,2-propanediol | 7 | 13.8 | 13.8 | 13.8 | 10 | 13.8 |
| Glycerine | 4 | 0 | 3.1 | 2.1 | 4.1 | 2.1 |
| Dipropylene Glycol | 4 | 0 | 0 | 0 | 0 | 0 |
| Sodium cumene sulphonate | 0 | 0 | 0 | 0 | 2.0 | 0 |
| AES | 8 | 18 | 9.5 | 12.5 | 10 | 12.5 |
| LAS | 5 | 18 | 9.5 | 14.5 | 7.5 | 9.5 |
| Isalchem ® 156 AS | 15 | 0 | 5 | 0 | 10 | 0 |
| AE | 13 | 3 | 16 | 2 | 13 | 2 |
| Citric Acid | 1 | 0.6 | 0.6 | 1.56 | 0.6 | 0.6 |
| $C_{12-18}$ Fatty Acid | 4.5 | 10 | 4.5 | 14.8 | 4.5 | 10 |
| Enzymes | 1.0 | 1.7 | 1.7 | 2.0 | 1.7 | 1.7 |
| Ethoxylated Polyethylenimine | 1.4 | 1.4 | 4.0 | 6.0 | 4.0 | 4.0 |
| Chelant | 0.6 | 0.6 | 1.2 | 1.2 | 3.0 | 1.2 |
| PEG-PVAc Polymer | 4 | 2.5 | 4 | 2.5 | 1.5 | 2.5 |
| Fluorescent Brightener | 0.15 | 0.4 | 0.3 | 0.3 | 0.3 | 0.3 |
| Monoethanolamine | 9.8 | 8.0 | 8.0 | 8.0 | 9.8 | 8.0 |
| TIPA | 0 | 0 | 2.0 | 0 | 0 | 0 |
| Triethanolamine | 0 | 2.0 | 0 | 0 | 0 | 0 |
| Cyclohexyl dimethanol | 0 | 0 | 0 | 2.0 | 0 | 0 |
| Water | 12 | 10 | 10 | 10 | 10 | 10 |
| Structurant | 0.1 | 0.14 | 0.14 | 0.1 | 0.14 | 0.14 |
| Perfume | 0.2 | 1.9 | 1 | 1.9 | 1.9 | 1 |
| Hueing Agent | 0 | 0.1 | 0.001 | 0.0001 | 0 | 0.1 |
| Buffers | | | To pH 8.0 | | | |
| Other Solvents (1,2 propanediol, ethanol) | | | To 100% | | | |

All enzyme levels are expressed as % enzyme raw material.

Raw Materials for Examples 2-3

LAS is linear alkylbenzenesulfonate having an average aliphatic carbon chain length $C_{11}$-$C_{12}$ supplied by Stepan, Northfield, Ill., USA or Huntsman Corp. HLAS is acid form.

AES is $C_{12-14}$ alkyl ethoxy (3) sulfate, $C_{14-15}$ alkyl ethoxy (2.5) sulfate, or $C_{12-15}$ alkyl ethoxy (1.8) sulfate, supplied by Stepan, Northfield, Ill., USA or Shell Chemicals, Houston, Tex., USA.

AE is selected from $C_{12-13}$ with an average degree of ethoxylation of 6.5, $C_{11-16}$ with an average degree of ethoxylation of 7, $C_{12-14}$ with an average degree of ethoxylation of 7, $C_{14-15}$ with an average degree of ethoxylation of 7, or $C_{12-14}$ with an average degree of ethoxylation of 9, all supplied by Huntsman, Salt Lake City, Utah, USA.

AS is a $C_{12-14}$ sulfate, supplied by Stepan, Northfield, Ill., USA.

HSAS is mid-branched alkyl sulfate as disclosed in U.S. Pat. No. 6,020,303 and U.S. Pat. No. 6,060,443.

$C_{12-14}$ Dimethylhydroxyethyl ammonium chloride, supplied by Clariant GmbH, Germany.

$C_{12-14}$ dimethyl Amine Oxide is supplied by Procter & Gamble Chemicals, Cincinnati, USA.

Sodium tripolyphosphate is supplied by Rhodia, Paris, France.

Zeolite A is supplied by Industrial Zeolite (UK) Ltd, Grays, Essex, UK.

1.6R Silicate is supplied by Koma, Nestemica, Czech Republic.

Sodium Carbonate is supplied by Solvay, Houston, Tex., USA.

Acrylic Acid/Maleic Acid Copolymer is molecular weight 70,000 and acrylate:maleate ratio 70:30, supplied by BASF, Ludwigshafen, Germany.

PEG-PVAc polymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).

Ethoxylated Polyethylenimine is a 600 g/mol molecular weight polyethylenimine core with 20 ethoxylate groups per-NH. Available from BASF (Ludwigshafen, Germany).

Zwitterionic ethoxylated quaternized sulfated hexamethylene diamine is described in WO 01/05874 and available from BASF (Ludwigshafen, Germany).

Grease Cleaning Alkoxylated Polyalkylenimine Polymer is a 600 g/mol molecular weight polyethylenimine core with 24 ethoxylate groups per-NH and 16 propoxylate groups per-NH. Available from BASF (Ludwigshafen, Germany).

Carboxymethyl cellulose is Finnfix® V supplied by CP Kelco, Arnhem, Netherlands.

Amylases (Natalase®, Stainzyme®, Stainzyme Plus®) may be supplied by Novozymes, Bagsvaerd, Denmark.

Savinase®, Lipex®, Celluclean™, Mannaway®, Pectawash®, and Whitezyme® are all products of Novozymes, Bagsvaerd, Denmark.

Proteases may be supplied by Genencor International, Palo Alto, Calif., USA (e.g. Purafect Prime®) or by Novozymes, Bagsvaerd, Denmark (e.g. Liquanase®, Coronase®). Suitable Fluorescent Whitening Agents are for example, Tinopal® TAS, Tinopal® AMS, Tinopal® CBS-X, Sulphonated zinc phthalocyanine, available from BASF, Ludwigshafen, Germany.

Chelant is selected from, diethylenetetraamine pentaacetic acid (DTPA) supplied by Dow Chemical, Midland, Mich., USA, hydroxyethane di phosphonate (HEDP) supplied by Solutia, St Louis, Mo., USA; Ethylenediamine-N,N'-disuccinic acid, (S,S) isomer (EDDS) supplied by Octel, Ellesmere Port, UK, Diethylenetriamine penta methylene phosphonic acid (DTPMP) supplied by Thermphos, or1, 2-dihydroxybenzene-3,5-disulfonic acid supplied by Future Fuels Batesville, Ark., USA.

Hueing agent is Direct Violet 9 or Direct Violet 99, supplied by BASF, Ludwigshafen, Germany.

Soil release agent is Repel-o-tex® PF, supplied by Rhodia, Paris, France.

Suds suppressor agglomerate is supplied by Dow Corning, Midland, Mich., US.

***Suds suppressor derived from phenylpropylmethyl substituted polysiloxanes, as described in the specification.

Acusol 880 is supplied by Dow Chemical, Midland, Mich., USA.

TAED is tetraacetylethylenediamine, supplied under the Peractive® brand name by Clariant GmbH, Sulzbach, Germany.

Sodium Percarbonate supplied by Solvay, Houston, Tex., USA.

NOBS is sodium nonanoyloxybenzenesulfonate, supplied by Future Fuels, Batesville, Ark., USA.

"The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

"Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern."

"While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention."

What is claimed is:

1. A process for manufacturing an aqueous liquid or gel-form laundry detergent comprising the steps of:

(i) at a first location, preparing a shippable anionic surfactant paste consisting essentially of:

from about 30% to about 75% by weight of an anionic surfactant selected from the group consisting of linear or branched alkyl sulfates, linear or branched alkoxylated alkyl sulfates, and mixtures thereof, from about 3% to about 18% of a primary solvent of formula (I)

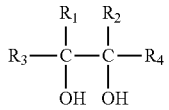

(I)

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, from about 0.1% to about 18% of a secondary solvent selected from the group consisting of a monoalcohol of formula (II)

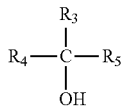

(II)

wherein each of $R_3$, $R_4$, and $R_5$ is independently selected from H or a substituted or unsubstituted, linear or branched $C_1$-$C_6$ alkyl group, glycerine, propoxylated glycerine, ethoxylated glycerine, 1,2-propylene glycol, diethylene glycol, dipropylene glycol, and mixtures thereof, wherein the balance of the paste is water;

(ii) shipping the anionic surfactant paste to a second location;

(iii) at the second location, adding said anionic surfactant paste to a composition comprising a surfactant and adjuncts, thereby forming the laundry detergent.

2. A process according to claim 1 wherein said paste is substantially free of a diol having only terminal hydroxyl groups.

3. A process according to claim 1 wherein said paste is substantially free of a diol having only terminal hydroxyl groups, the distance between said terminal hydroxyl groups being 3 carbon atoms.

4. A process according to claim 1 wherein said paste is substantially free of 1, 3-propanediol and 2-methyl-1, 3-propanediol.

5. A process according to claim 1 wherein said anionic surfactant is $C_{12}$-$C_{16}$ linear or branched alkoxylated alkyl sulfate.

6. A process according to claim 1 wherein said anionic surfactant is selected from the group consisting of 2-alkyl branched primary alkyl sulfates.

7. The process according to claim 1 wherein said adjunct is selected from the group consisting of a structurant, a builder, a fabric softening agent, a polymer or an oligomer, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, and mixtures thereof.

8. The process according to claim 1 wherein said laundry detergent comprises an enzyme selected from the group consisting of lipase, amylase, protease, mannanase, cellulase, pectinase, and mixtures thereof.

9. The process according to claim 1, wherein said laundry detergent comprises from about 0.001% to about 1% by weight of enzyme.

10. The process according to claim 1 wherein said laundry detergent is a form selected from the group consisting of a liquid laundry detergent, a gel detergent, a single-phase or multi-phase unit dose detergent, a detergent contained in a single-phase or multi-phase or multi-compartment water-soluble pouch, a laundry pretreat product, a fabric softener composition, and mixtures thereof.

11. The process according to claim 1 wherein said laundry detergent comprises less than about 20% water.

12. The process according to claim 1 wherein said laundry detergent is a detergent contained in a single-phase or multi-phase or multi-compartment water-soluble pouch.

13. A process for manufacturing an aqueous liquid or gel-form laundry detergent comprising the steps of:

(i) at a first location, preparing a shippable anionic surfactant paste consisting essentially of:

from about 30% to about 75%, by weight of an anionic surfactant selected from the group consisting of linear or branched alkyl sulfates, linear or branched alkoxylated alkyl sulfates, and mixtures thereof, from about 3% to about 18% of a solvent of formula (I)

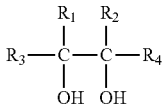

(I)

where each of $R_1$ and $R_2$ is independently selected from a substituted or unsubstituted $C_1$-$C_6$ alkyl group and where each of $R_3$ and $R_4$ is independently selected from H, a branched or linear $C_2$-$C_6$ alkyl group, an aryl group, or an alkyloxy group, wherein the balance of said paste is water;

(ii) shipping the anionic surfactant paste to a second location;

(iii) at the second location, adding said anionic surfactant paste to a composition comprising a surfactant and adjuncts.

14. A process according to claim 5 wherein said anionic surfactant is $C_{14}$-$C_{16}$ linear or branched alkoxylated alkyl sulfate.

* * * * *